US007988561B1

(12) United States Patent
Lenkarski et al.

(10) Patent No.: US 7,988,561 B1
(45) Date of Patent: Aug. 2, 2011

(54) BASE FRAME FOR GAME USING AN ELECTRIC PROBE IN ADAPTABLE CONFIGURATIONS

(75) Inventors: Lee M. Lenkarski, Belchertown, MA (US); Joseph DeCarolis, Bristol, CT (US)

(73) Assignee: Hasbro, Inc., Pawtucket, RI (US)

( * ) Notice: Subject to any disclaimer, the term of this patent is extended or adjusted under 35 U.S.C. 154(b) by 949 days.

(21) Appl. No.: 11/863,695

(22) Filed: Sep. 28, 2007

(51) Int. Cl.
*G06F 19/00* (2011.01)
*A63B 71/00* (2006.01)

(52) U.S. Cl. ..... 463/46; 463/7; 273/447; 273/455

(58) Field of Classification Search ..... 273/236–237, 273/273, 455; 446/175; 463/6, 46
See application file for complete search history.

(56) References Cited

U.S. PATENT DOCUMENTS 2,808,263 A * 10/1957 Goldfinger et al. ..... 273/455
3,333,846 A 8/1967 Glass et al.
3,488,053 A * 1/1970 Patel ..... 273/455
4,039,184 A 8/1977 Breslow et al.
4,236,714 A * 12/1980 Locke ..... 273/238
4,385,762 A * 5/1983 Schwartz ..... 273/454
5,295,694 A 3/1994 Levin
6,102,397 A * 8/2000 Lee et al. ..... 273/238
7,008,316 B1 3/2006 Pugh
7,059,964 B1 * 6/2006 Harpaz ..... 463/9
7,147,555 B1 * 12/2006 Harpaz ..... 463/9
7,172,196 B2 2/2007 Randall

* cited by examiner

*Primary Examiner* — Dmitry Suhol
*Assistant Examiner* — Alex F. R. P. Rada, II
(74) *Attorney, Agent, or Firm* — Perry Hoffman

(57) ABSTRACT

A revised universal base structure which is adapted for use in manufacturing various different versions of an electromechanical game using the same base structure. The base structure provides a network or grid of recessed areas above which a ground plate may extend. The recessed areas are formed as small squares and various small playing pieces are receivable in the recesses so that they can be retrieved by players during the course of game play. However, the base structure can be used with various uniquely different ground plates and unique upper boards to form various different embodiments of the differing games.

20 Claims, 4 Drawing Sheets

BASE FRAME FOR GAME USING AN ELECTRIC PROBE IN ADAPTABLE CONFIGURATIONS

BACKGROUND OF THE INVENTION

1. Field of the Invention

The present invention relates to electromechanical toys. More particularly, the invention relates to an interchangeable frame for board game, a board game that requires precise grasping of objects and signals a player when the collecting of an object was not precise.

2. Description of the Related Art

Similar to many industries, the toy industry constantly adapts new technology to current products and trends as the cost of implementing new technology becomes economically efficient.

The efficiency of adapting new technology usually falls into either the cost of components for the toy or the manufacturing process of the toy. The components of electric feedback between a player motivated tool and a game board is well known and used.

For example, a board game that requires precise grasping of objects and signals a player when the collecting of the object was not precise is disclosed in U.S. Pat. No. 5,295,694 entitled "Laparoscopic Surgery Simulating Game" to Levin, issued Mar. 22, 1994. The '694 patent discloses a game whereby the player, acting as a surgeon, must remove articles from a patient. If the player's grasping is not precise the game audibly informs the player.

A similar use of electric feedback through a player manipulated tool and a board game, is a game that requires precise movement of a pointer within a preset path, signaling a player when the path is not followed as disclosed in U.S. Pat. No. 3,333,846 entitled "Game Utilizing Electric Probe" to Glass et al., issued Aug. 1, 1967. The object of the subject game is for the players to utilize the tweezers to remove various objects from their respective cavities without touching the electrically conductive perimeter of those cavities with the tweezers during the extraction process, thereby simulating the successful performance of an operation. If the player should touch the perimeter of the cavity with the tweezers such action completes the electrical circuit and causes the buzzer to sound and the lamp to illuminate.

In particular, the aforementioned game consists of a plastic-framed platform in which a cardboard panel bearing the image of a cartoon-like male patient (designated as "Cavity Sam") is located. An electrically conductive panel is located under the cardboard panel and is connected to one pole of a pair of batteries. A light bulb extending out a hole in the cardboard panel at the location of Cavity Sam's nose is electrically connected to the electrically conductive panel. A buzzer is also provided connected to the electrically conductive panel. The other pole of the batteries is connected to a pair of electrically conductive tweezers. A plurality of different, uniquely shaped openings are provided in the cardboard panel at various locations on the anatomy of Cavity Sam. The electrically conductive panel includes correspondingly shaped openings, but smaller in size than the openings in the cardboard panel, so that the periphery of the conductive panel about each opening therein is exposed.

The plastic platform includes plural cavities located under the openings in the cardboard and electrically conductive panels and into which the respective molded plastic objects are to be located. Each of these objects is humorously related to a respective portion of the anatomy of Cavity Sam. For example, one object is shaped like a bone and is located in a correspondingly shaped cavity designated on the arm portion of Cavity Sam's anatomy as a "funny bone." Another object is heart shaped is located in a correspondingly shaped cavity designated on the chest of Cavity Sam as a "broken heart." Still another object is shaped like a pail of water, is located in a correspondingly shaped cavity on Cavity Sam's knee and is designated as "water on the knee."

The components for electric feedback with a player motivated tool and a board game are, therefore, well known and used. However, these games still present a problem when attempting to adapt their style of game play to a plurality of marketable board games featuring diverse appearances and characters using an economically efficient manufacturing process.

Apart from the actual materials used for the creation of the board game, the manufacturing process can create cost efficiency problems. Manufacturing techniques such as injection molding and various types of casting can create the game parts with little human interaction and relatively quickly. However, the most significant costs involved in these manufacturing processes are the assortment of molds needed to create the game parts, and the manufacturing down-time associated with setting up the different molds or castings, needed for a plurality of different board games featuring diverse appearances and characters, into their respective machines.

Therefore, a need exists for a game utilizing electronic feedback through a player motivated tool and a board game that can 1) reduce the number of molds or castings needed to create a plurality of marketable board games featuring diverse appearances and characters and 2) reduce the manufacturing down-time associated with setting up and switching between different molds or casting needed for board games featuring diverse appearances and characters associated with a plurality of different board games.

SUMMARY OF THE INVENTION

The present invention solves the aforementioned needs by creating a board game that features electromechanical feedback between a player motivated tool or device and the board game using a frame device, which facilitates adaptable configurations and requires a single mold or casting, for a plurality of different board games featuring diverse appearances and characters, therefore, requiring no additional manufacturing down-time associated with setting up and switching between molds or castings. The described embodiments are further capable of being easily operable to a diverse number of game situations featuring marketable characters incorporating different game board faces and operating modules.

Briefly summarized, the present embodiment is a revised universal base structure or frame which is adapted for use in manufacturing various different versions of a board game or other electromechanical games, e.g. in the present case Operation™ but not limited thereto, using the same base structure. The frame comprises a network or grid of recessed areas above which a ground plate can extend. The recessed areas are formed as small squares and various small playing pieces are receivable in the recesses so that they can be retrieved by players during the course of game play. However, the base structure can be used with various different ground plates, upper boards, and operating modules to form various different embodiments of the Operation Game™, in the present embodiment.

DETAILED DESCRIPTION OF THE EMBODIMENTS

Figure 1:
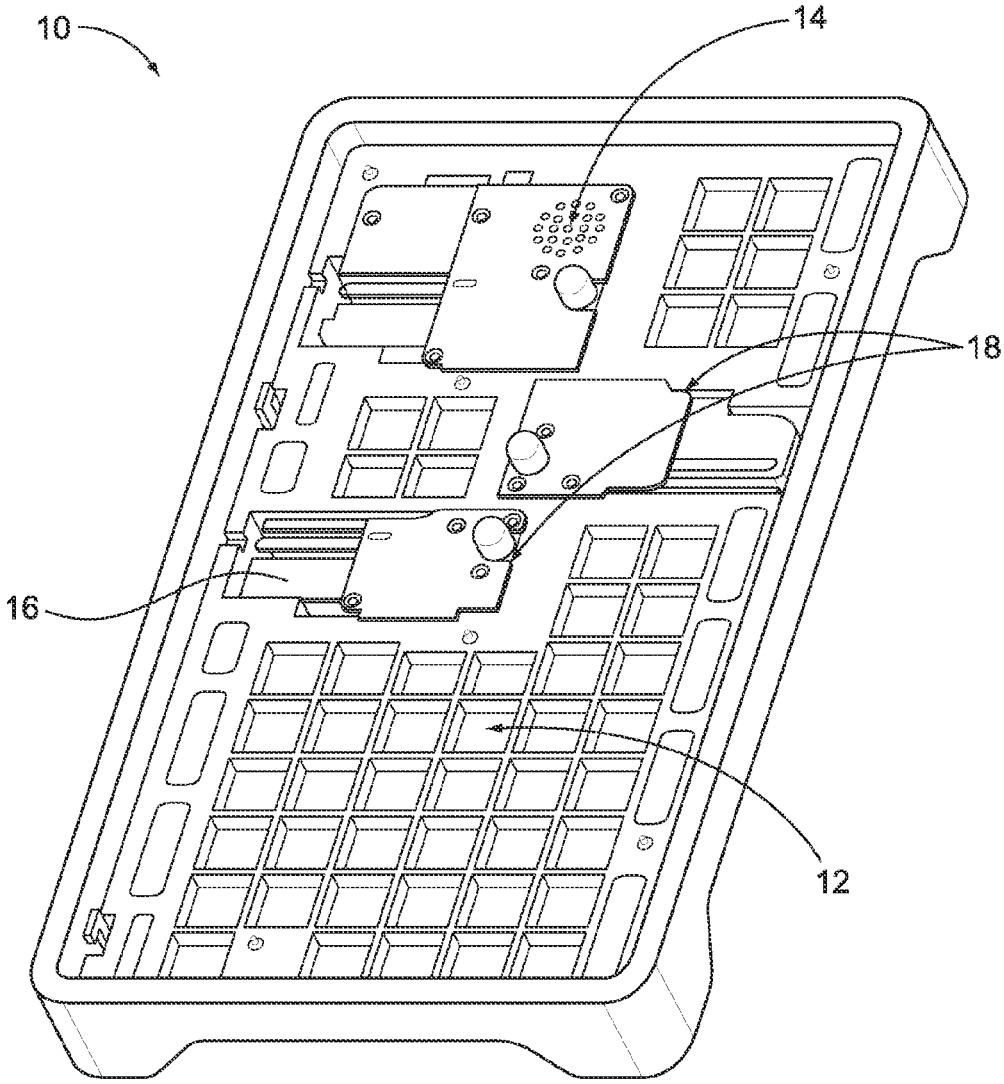
FIG. 1 is a perspective view of the board game frame illustrating possible positions of the sound effect or standard modules along with several ailment openings.
Figure 3:
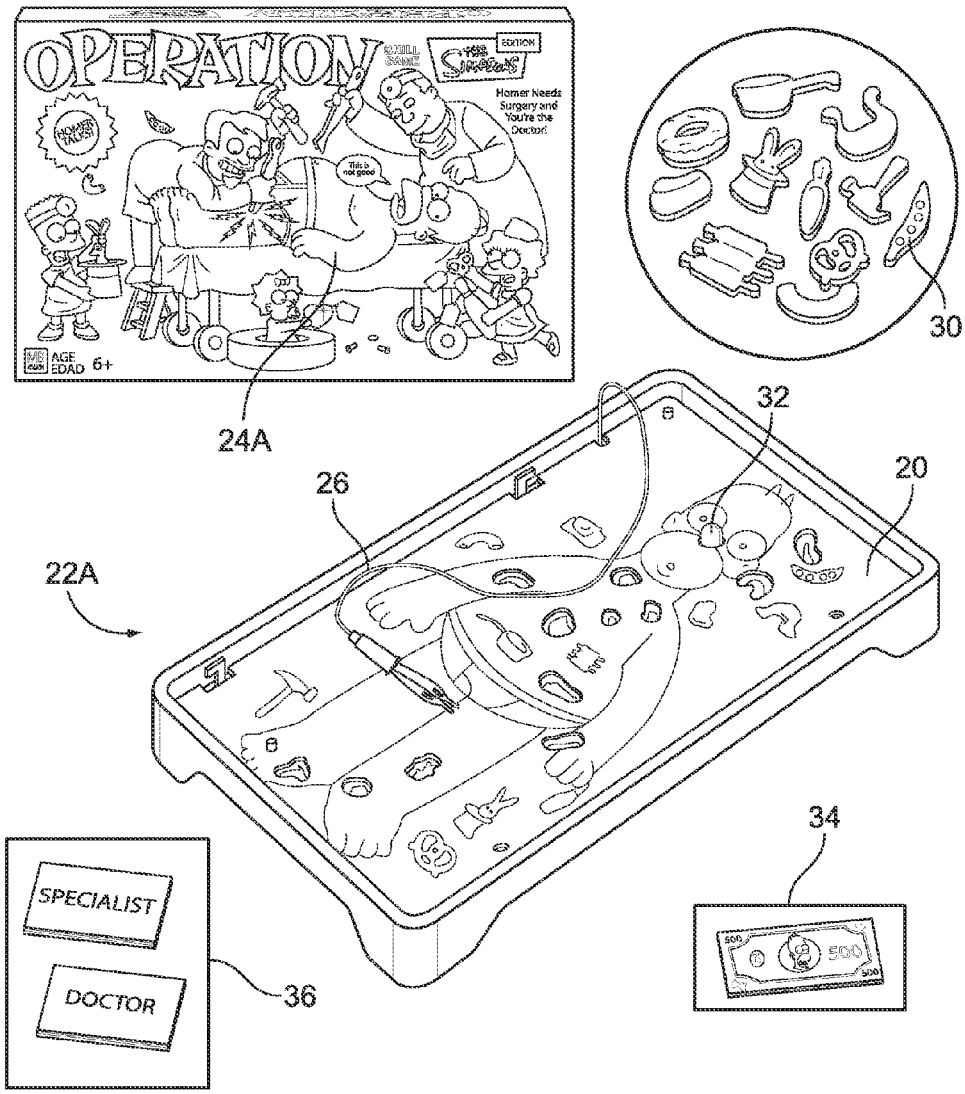
FIG. 3 is a plan view of an embodiment featuring a character design shown in a second embodiment.
Figure 4:
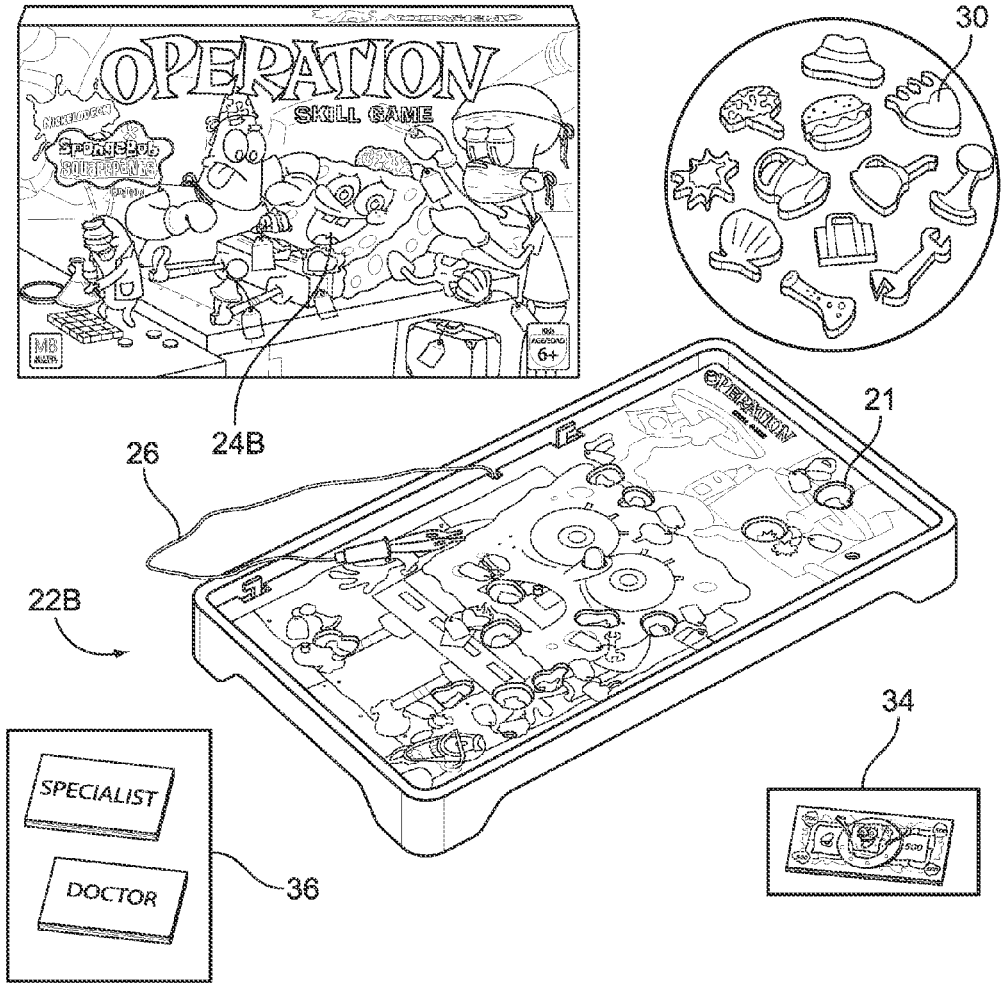
FIG. 4 is a plan view of an embodiment featuring a character design shown in the first described embodiment in accordance with the present invention.

The frame, generally shown in FIG. 1 as reference numeral 10, is a device that facilitates adaptable configurations with an electromechanical game. FIG. 1 facilitates the board game frame providing possible positions of sound effect and/or standard modules along with forty-nine ailment openings, as illustrated. The frame 10 is used in board games 22A and 22B which feature electromechanical feedback between a player motivated tool or device 26, an electric probe in the presently described embodiment, and the board games 22A, 22B in a form employing a single mold or casting for a plurality of different board games. Accordingly the board games 22A, 22B may feature diverse appearances and characters, e.g., character, design, or indicia 24A, 24B such as that corresponding to the particular brand of game 22A, 22B as seen in FIGS. 3 and 4 discussed below.

The present embodiment relates to a revised universal base structure 10 which is adapted for use in manufacturing various different versions of the Operation Game™ using the same base structure 10. The frame 10 comprises a network or grid of recessed areas or game activity portions 12 above which an overlay 20, 21 can extend. The recessed areas 12 are formed as small squares and various small playing pieces 30 are receivable in the recesses 12 so that the pieces 30 can be retrieved by players during the course of game play. However, the base structure 10 can be used with an assortment of overlays 20, 21 to form various different embodiments of the Operation™ game. The revised universal base structure is advantageously adapted for use in manufacturing various different versions of an electromechanical game using the same base structure. Accordingly the base structure provides a network or grid of recessed areas above which a ground plate may extend. The recessed areas are formed as small squares and various small playing pieces are receivable in the recesses so that they can be retrieved by players during the course of game play unique to the particular game design.

The frame 10, composed of polymers, metals or the like, is formed to allow multiple versions of a board game 22A, 22B to easily be assembly using the frame 10. The frame 10, therefore, includes game activity portions, ailment openings 12 in the present embodiment, and module openings 18. The frame 10 is further capable of being attached to an overlay, a ground plate 28 and an upper board 20 in the present embodiment. In the present embodiment, the frame 10 is composed of a non-conductive material and the length, width, and thickness of the frame 10 is standardized for use with an assortment of versions of the game 22A, 22B.

A first module, a standard module 16 in the present embodiment, and a second module, a sound effect module 14 in the present embodiment, are designed to fit into the module openings 18 located at the frame 10. The standard module 16 and the sound effect module 14 are responsive to a circuit being formed during game play such as the tool 26 contacting the ground plate 28. The modules 14, 16 alert a player to contact between the tool 26 and the ground plate 28, through audible (speech and sound effects) and visual (illuminated nose light 32) means in the present embodiment. The first module 16 directs the illumination of the nose light 32 in the present embodiment. The second module 14 issues audible customized to the particular game 22A, 22B in the present embodiment.

The game activity portions 12 are recessed areas formed as small squares and various small playing pieces 30 are receivable in the recesses 12 so that small playing pieces 30 can be retrieved by players during the course of game play. In the present embodiment, indicia are place within the ailment openings 12 corresponding to a particular game piece 30 housed within the ailment opening during game play. The ailment openings 12 comprise a network or grid of recessed areas above which a ground plate 28 can extend.

Figure 2:
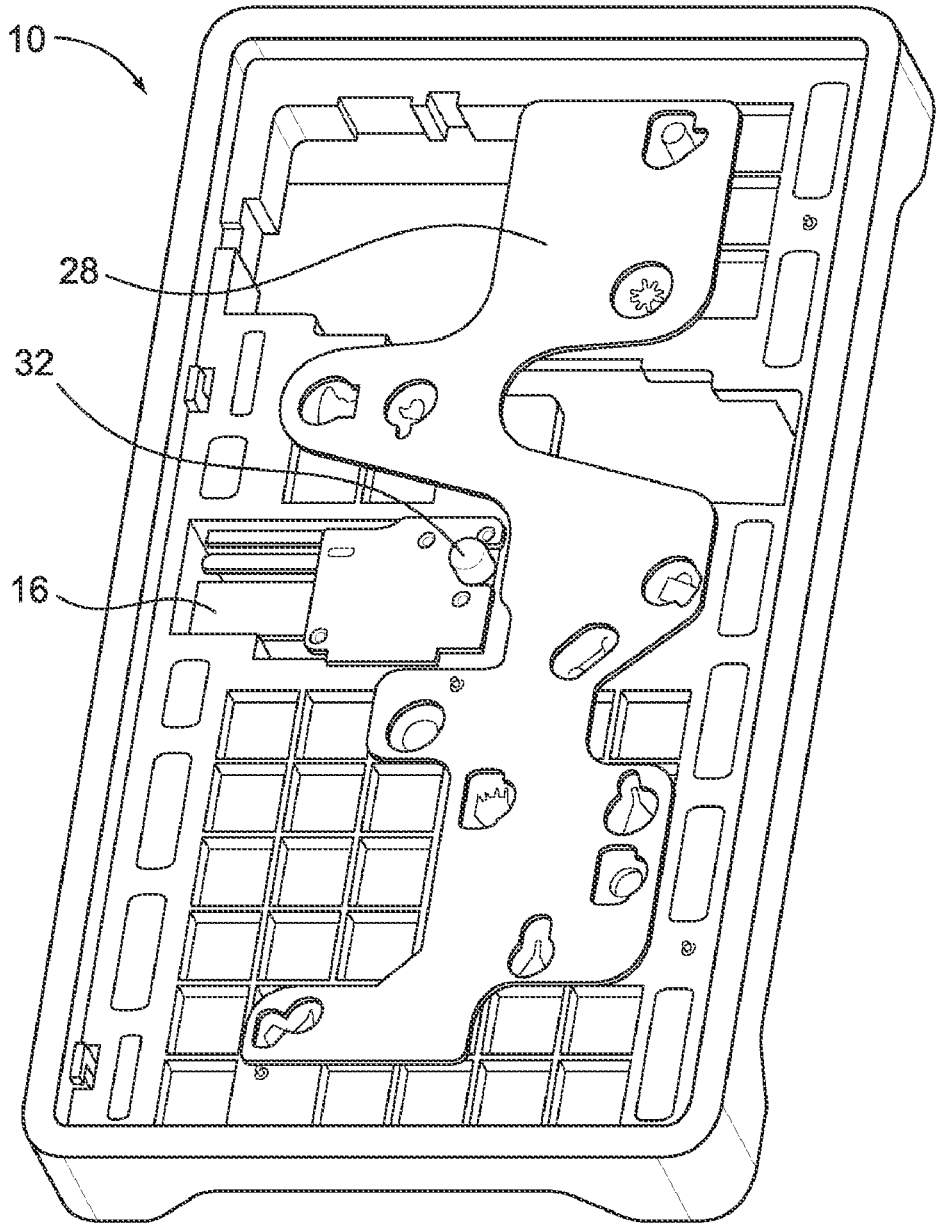
FIG. 2 is a perspective view of the board game frame configured for a first embodiment with the standard module in the lower position with the ailments and ground plate shown.

FIG. 2 illustrates the board game frame configured for use in the SpongeBob Squarepants™ licensed embodiment with the standard module in the lower position with the ailments and ground plate as shown. The ground plate 28 overlay, as shown in FIG. 2 is made of an electrically conductive material. When the player motivated tool 26 contacts the ground plate 28 a circuit is made. FIG. 3 provides a plan view of an embodiment featuring a character design shown in the The Simpsons™ embodiment; and FIG. 4 provides a plan view of an embodiment featuring a character design shown in the SpongeBob Squarepants™ embodiment design. The ground plate can be configured in a plurality of shapes and forms as seen in FIG. 2 and FIG. 3. The shape of the ground plate 28 corresponds to the shape of the upper board 20 as well as the character or design of the game 22A, 22B. The positioning and shape of the ground plate 28 is responsible for outlining the limits of the ailment openings 12 used in the particular version of the game 22A, 22B.

Similar to the ground plate 28, the upper board 20 overlay is located at the frame 10 and is customized for a particular game 22A, 22B. The upper board 20 can house a character, design, or indicia 24A, 24B corresponding to the particular brand of game 22A, 22B as seen in FIGS. 3 and 4. The upper board 20 also helps to outline the playable area and game activity portions 12 to the player. In the present embodiment the upper board 20 is made of a non-conductive material. Therefore, if the tool 26 contacts the upper board 20, no circuit is created.

A method for manufacturing the adaptable frame 10 includes molding or casting a frame featuring a plurality of module openings 14, 16 in the frame 10, a network or grid of recessed spaces 12 on the frame 10, and a surface to attach an overlay, which may comprises a ground plate 28 and an upper board 20 on the frame 10. The frame 10 can be manufactured through multiple means such as, but not limited to, injection molding, blow molding, die casting, or sand casting. The frame 10 can further be covered with the graphic design 24A, 24B of the respective game 22A, 22B. The dimensions of the frame 10 allows for numerous injection points for the molding, points where the resultants injection tags can be broken off the frame 10 safely and efficiently. Moreover, the frame 10 is thin to reduce cavities that may occur in the frame 10 through differences in cooling times between different areas of the frame 10 associated with the injection molding procedure. This allows the frame 10 to have a structurally uniform composition, reducing stress and failure points that may occur if cavities form inside the frame 10 during the molding process. The frame 10 is further textured with an assortment of surface features that allows the multiple parts such as the ground plate 28 and upper board 20 to be assembled on the frame 10.

A method for manufacturing a game 22A, 22B includes creating an interchangeable frame 10, positioning a standard module 16 and/or a sound effect module 14 into the frame 10, selecting ailment openings 12 to be used in game 22A, 22B, applying ground plate 28 that corresponds to selected ailment openings 12, and apply upper board 20 to the frame 10. The frame 10 may further include a graphic design 24A, 24B set on the frame 10. The assortment of different versions of game 22A, 22B can be created from the same initial frame 10.

A method for playing the game, in the present embodiment, requires separating the cards 36 into two decks: Doctor Cards and Specialist cards. The players shuffle the Specialist cards and deal them out face-up, one at a time, so that each player gets an equal number. The players then place any extra Specialist cards out of the game. The players then shuffle the Doctor cards and place the deck face-down near the game 22A, 22B. Next, a player is chosen to be the banker. This player will pay for the successful "operations." The banker places the money 34 nearby, in piles by denomination. The players then drop each Funatomy™ part 30 into its matching game activity portion 12. One player goes first and draws the top Doctor card from the deck and reads it aloud. The card indicates which Funatomy™ part 30 to be removed, and what fee will be paid if successful. To perform the "operation," the players use the tweezers 26 to remove the Funatomy™ part 30 from the ailment opening 12. If the tweezers 26 contact the edge of the ailment opening 12, the light 32 will illuminate, and the players will hear the game 22A, 22B say anything from "Why me?" to "Ow! Ow! Ow!" If the players remove the part 30 without setting off touching the sides of the ailment opening 12 then the players keep the fee. If the players touch the sides then the players' turn is over.

After completing the Doctor cards, the players use the Specialist cars, which play the same way as the Doctor. The game ends when all 12 "operations" have been successfully performed. The player with the most money 34 is the winner.

The game 22A, 22B can also be played with only one player. The player attempts to remove the parts without toughing any side of any ailment opening 12. When the players are finished playing the game 22A, 22B, they can anchor the tweezers 26 by pressing down on the front and gently sliding them under a notch on the game 22A, 22B. The game pieces 30 can be stored under the game 22A, 22B.

It should be appreciated that a wide range of changes and modifications may be made to the embodiments of the inventions as described herein. It is intended that the foregoing detailed description be regarded as illustrative rather than limiting. While there have been illustrated and described particular embodiments of the inventions, it will be appreciated that numerous changes and modifications will occur to those skilled in the art, and it is intended in the appended claims to cover those changes and modifications which fall within the true spirit and scope of the present invention.

What is claimed is:

1. A game assembly facilitating adaptable configurations for electromechanical game play, comprising:

a frame for receiving one of a first overlay or a second overlay;

a plurality of frame openings in the frame including a plurality of game activity recesses;

said first overlay comprising a first upper board defining a plurality of first upper board openings therein, the first overlay further comprising a first ground plate defining a plurality of first ground plate openings which correspond with two or more of the first upper board openings in positions to align on the frame operable with the first ground plate and with two or more of the game activity recesses on the frame;

said second overlay comprising a second upper board defining a plurality of second upper board openings therein, the second overlay further comprising a second ground plate defining a plurality of second ground plate openings which correspond with two or more of the second upper board openings in positions to align on the frame operable with the second ground plate and with two or more of the game activity recesses on the frame;

one or more modules for being received in one or more of the frame openings positioning the first module into the frame operable with the first ground plate for generating electromechanical game play activity common to both the first overlay and the second overlay; and said one or more modules received in one or more of the frame openings for generating electromechanical game play activity unique to the first overlay when the first overlay is on the frame.

2. A game assembly as recited in claim 1, wherein said one or more modules further comprises a second module received in said one or more of the frame openings positioning the second module into the frame operable with the second ground plate for generating electromechanical game play activity unique to the second overlay when the second overlay is on the frame.

3. A game assembly as recited in claim 1, wherein said first overlay and said second overlay each comprise an upper board and a graphic design thereon provided respectively in relation to said first and said second ground plate openings and the game activity recesses for the electromechanical game activity.

4. A game assembly facilitating adaptable configurations within an electromechanical game, comprising:

a frame;

a plurality of game activity recesses in the frame;

an overlay comprising one of a first overlay or a second overlay, said frame receiving one of said first overlay or said second overlay at said frame, said frame receiving said first overlay when said second overlay is not received at said frame;

said first overlay comprising a first ground plate defining a plurality of first ground plate openings therein which align on the frame operable with the first ground plate and with two or more of the game activity recesses in the frame;

a first module for first electromechanical game activity;

a second module for second electromechanical game activity unique to the overlay;

a first module opening in the frame for receiving the first module under the first ground plate in relation to the two or more of the game activity recesses on the frame, said first module opening positioning the first module within the frame and under the first ground plate; and a second module opening in the frame for receiving the second module under the first ground plate in relation to the two or more of the game activity recesses on the frame, said second module opening positioning the second module within the frame and under the first ground plate.

5. A game assembly as recited in claim 4, wherein the overlay comprises an upper board and a graphic design thereon provided in relation to the first ground plate openings and the game activity recesses for the electromechanical game activity.

6. A game assembly as recited in claim 5, wherein said first module opening positioning the first module into the frame operable with the first ground plate for generating electromechanical game play activity common to both the first overlay and the second overlay.

7. A game assembly as recited in claim 6, wherein said second module opening positioning the second module into the frame operable with the first ground plate for generating electromechanical game play game activity corresponding with the first overlay when the first overlay is on the frame.

8. A game assembly facilitating adaptable configurations within an electromechanical game, comprising:

a frame;

a plurality of game activity recesses in the frame;

a first overlay comprising a first ground plate defining a plurality of first ground plate openings therein which align on the frame operable with the first ground plate and with two or more of the game activity recesses in the frame;

a second overlay comprising a second ground plate defining a plurality of second ground plate openings therein which align on the frame operable with the second ground plate and with two or more of the game activity recesses in the frame;

said frame receiving said first overlay at said frame wherein said second overlay is not received at said frame;

a first module for first electromechanical game activity;

a second module for second electromechanical game activity corresponding with the first overlay;

a first module opening in the frame for receiving the first module under the first ground plate in relation to the two or more of the game activity recesses on the frame, said first module opening positioning the first module within the frame and under the first ground plate; and a second module opening in the frame for receiving the second module under the first ground plate in relation to the two or more of the game activity recesses on the frame, said second module opening positioning the second module within the frame and under the first ground plate.

9. A game assembly as recited in claim 8, wherein said first overlay comprises a first upper board and a first graphic design thereon provided in relation to said first ground plate openings and the game activity recesses for the electromechanical game activity unique to the first overlay and the first graphic design thereon.

10. A game assembly as recited in claim 8, said frame receiving said second overlay at said frame wherein said first overlay is not received at said frame, said second module further comprising electromechanical game activity corresponding with the second overlay with said first module opening positioning the first module within the frame and under the second ground plate.

11. A game assembly as recited in claim 10, wherein said second module opening in the frame receives the second module under the second ground plate in relation to the two or more of the game activity recesses on the frame with said second module opening positioning the second module within the frame and under the second ground plate.

12. A game assembly as recited in claim 11, wherein said first overlay and said second overlay each comprise an upper board and a graphic design thereon provided respectively in relation to said first and said second ground plate openings and the game activity recesses for the electromechanical game activity.

13. A game assembly as recited in claim 12, said second overlay comprising an upper board and a graphic design thereon provided in relation to the second ground plate openings and the game activity recesses, wherein the second module comprises a sound effect module for the electromechanical game activity unique to the second overlay.

14. A game assembly as recited in claim 8, comprising a player motivated tool.

15. A method for manufacturing a game assembly facilitating adaptable configurations with an electromechanical game, comprising:

providing a frame for a game assembly;

defining game activity recesses on the frame to be used in game play;

defining a plurality of openings in a ground plate to align with two or more of the game activity recesses on the frame;

positioning a first module into the frame operable with the ground plate;

positioning a second module into the frame; and applying an overlay to the frame above the ground plate, said second module providing electromechanical game activity unique to the overlay in relation to the ground plate openings and in relation to the two or more of the game activity recesses on the frame.

16. A method for manufacturing a game as recited in claim 15, wherein applying the overlay comprises applying the ground plate to the underside of the overlay.

17. A method for manufacturing a game as recited in claim 15, wherein applying the overlay comprises applying an upper board.

18. A method for manufacturing a game as recited in claim 15, wherein applying the overlay comprises applying a graphic design.

19. A method for manufacturing a game as recited in claim 15, comprising a sound effect module.

20. A method for manufacturing a game as recited in claim 15, comprising a graphic design for the game.

* * * * *